US006805957B1

(12) United States Patent
Santos et al.

(10) Patent No.: US 6,805,957 B1
(45) Date of Patent: Oct. 19, 2004

(54) CAMOUFLAGE U.S. MARINE CORPS UTILITY UNIFORM: PATTERN, FABRIC, AND DESIGN

(75) Inventors: Luisa DeMorais Santos, Franklin, MA (US); Deirdre E. Townes, Newton, MA (US); Gabriel R. Patricio, Stafford, VA (US); Carole Ann Winterhalter, Marlborough, MA (US); Anabela Dugas, Fall River, MA (US); Timothy R. O'Neill, Fall River, VA (US); Rosemary Ann Lomba, Westport, MA (US); Barbara J. Quinn, Framingham, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 22 days.

(21) Appl. No.: 09/986,016

(22) Filed: Nov. 7, 2001

(51) Int. Cl.[7] ..... D02G 3/00

(52) U.S. Cl. ..... 428/400; 428/913; 428/207; 428/180; 428/190; 428/310.5; 428/919

(58) Field of Search ..... 428/919, 913, 428/400, 310.5, 207, 180, 190, 17, 95

(56) References Cited

U.S. PATENT DOCUMENTS

| | | | | |
|---|---|---|---|---|
| 4,095,940 A | | 6/1978 | Weingarten et al. | |
| 4,656,065 A | * | 4/1987 | Yacovella | 428/17 |
| 5,074,889 A | | 12/1991 | Hodge et al. | |
| 5,077,101 A | * | 12/1991 | Conway et al. | 428/17 |
| D391,401 S | | 3/1998 | Josephs | |
| D391,402 S | | 3/1998 | Josephs | |
| D391,403 S | | 3/1998 | Josephs | |
| D393,547 S | | 4/1998 | Josephs | |
| 5,845,333 A | | 12/1998 | Crampton | |
| 5,972,479 A | * | 10/1999 | Lehman | 428/195 |
| 6,061,828 A | * | 5/2000 | Josephs | 2/69 |

OTHER PUBLICATIONS

Maj. Timothy R. O'Neil, Dual–Tex Camouflage Pattern, Armor, Nov–Dec, pp cvr. & 21–26, 1977.

Canadian Army Poster, Clothe the Soldier, Design: Land Staff Det Tech Team, 08/99.

http://www.abcnews.go.com/sections/us/DailyNews/camouflage010620.html June 20, 2001 edition.

Def. Tech Info Cntr. Report ADB020592, Dual–Tex 2: Field Evaluation of Dual–Texture Gradient Pattern, O'Neill, Report Date Jul. 1, 1977 (Release to public not yet determined).

Def. Tech Info Cntr. Report ADB053013, Investigation of Psychometric Correlates of Camouflaged Target Detection and Identification, O'Neill & Johnsmeyer, Report date: May 1, 1977 (General Distribution Date Unknown).

* cited by examiner

*Primary Examiner*—Merrick Dixon
(74) *Attorney, Agent, or Firm*—United States Marine Corps; A. David Spevack; Charles H. Harris

(57) ABSTRACT

A disruptive camouflage pattern system to be used for both military and civilian applications. The system includes specialized techniques for printing the camouflage pattern system unto fabric. The system provides camouflage in both the human visible light and the near infrared range. The system depends on macro pattern resulting from a repeat of a micro pattern. The coloring used includes at least four colorings from dyes that in combination produce a percent reflectance value comparable to that of the negative space of the camouflaged subject's surroundings. The system functions by a macro pattern being disruptive of the subject's shape and a micro pattern having sharp edge units of a size capable of blending the subject into its background. The relative lightness values and percentages of total pattern, wet or dry, are sufficient to produce a percent reflectance of acceptable colors, in terms of lightness values unlike current four-color camouflage.

10 Claims, 11 Drawing Sheets

CAMOUFLAGE U.S. MARINE CORPS UTILITY UNIFORM: PATTERN, FABRIC, AND DESIGN

BACKGROUND OF THE INVENTION

1. Field of the Invention

This invention relates to a camouflage pattern, and techniques that can be used to create a camouflage pattern. More particularly, the invention relates to a camouflage pattern used on fabric based structures that in combination with certain dyes, fabrics, and materials as well as certain printing techniques, provides improved concealment for military personnel, vehicles, and other equipment in a range of tactical environments. Also, the invention pertains to a camouflage system used on non-fabric equipment. In addition, the camouflage pattern is useful in the civilian sector for fashion, as well as sportsman. This invention combines principles of human perception, natural camouflage, and psychophysics to create two pattern elements of a macro-pattern and a micro-pattern combined into a single configuration: one to disrupt the features of the subject target, the other to match the subject target to the characteristics of the background. The combinations of this invention provide counter surveillance from visual and near-infrared detection for combat utility uniforms and equipment.

2. Related Applications

Design patent application Ser. No 29/143,340 titled "united states marine corps combat utility uniform" filed Jun. 13, 2001.

Design patent application Ser. No. 29/143,683 titled "camouflage pattern for sheet material and uniforms" filed 19 Jun. 22, 2001.

Provisional patent application No. 60/312,743 titled the same as above, filed Aug. 17, 2001 from which filing date benefit is claimed.

3. Description of the Prior Art

Camouflage is an art in the process of becoming a science. Camouflage, also called protective concealment, is a means to disguise a subject, whether animate or inanimate, in plain sight so as to conceal the subject from something or someone. Beginning with Abbott and Gerald Thayer in the late 1800's and Pycraft in the 1920's, camouflage evolved from a study of naturalistic observations of organisms in their complex environments to designs that purposely effect perception. The basic canon of natural camouflage includes "evolved tactics" such as mimicry (contrived similarity to background features, like the walking stick bug), countershading (lightened ventral surfaces to combat the contrast of shadow), and disruption (Thayer's "ruption"), the breakup of boundary features or internal structures.

Thayer noticed that the coloring of many animals graduated from dark, on their backs, to almost white on their bellies. The gradation from dark to light breaks up the surface of an object and makes it harder to see the object as one thing. The object loses its three-dimensional qualities and appears flat. The ratio of dark coloration to light coloration can mean the difference between success and failure of a design. Thayer called this 'ruption'—the development of patches of light and dark covering that served to break up the outline of the animal.

However, strategies based on natural observations often fall short of military requirements. There are two reasons for departing from the "natural" approach. First, animal coloration is often idiosyncratic and keyed to narrow co-evolution histories of predator and prey in a specific econiche—that is, the zebra's stripes tell us more about the visual system of the lion than about usable principles of military camouflage. Second, organisms are limited in the strategies (patterns) they can "employ." The coloration patterns of animals reflect survival probabilities over a long period of time passed on genetic advantage. However, animals do not "design" their appearance; the process is passive and represents genetic exploitation of random mutations. In addition, the processes by which natural patterns develop are constrained by biology.

Murray (1992) describes, for example, the process by which local interaction between two populations of color producing cells (melanophores) create different categories of patterns (stripes, spots, blotches, etc.) reminiscent of standing waves of different frequencies in metal sheets. It is significant requirement for this invention that a particular frequency or local melanophore interaction may produce a pattern that interrupts internal symmetry axes. Biological entities have the disadvantage of not being able to produce an animal with both spots and stripes, or with complex patterns of certain types.

Deliberate military camouflage as well as sportsman and fashion patterns does not suffer from these limitations. It is useful as well to remember that animals choose to inhabit certain fairly narrow econiches which in turn allows camouflage "strategies" very specific to particular places and backgrounds. Military forces do not have this luxury, and must adopt strategies more generally effective across a range of terrain and environmental conditions to which they may be deployed.

Brassey's Book of Camouflage by Tim Newark traces some of the history of camouflage. In 1812, some of the first experimentation done with camouflage found that the color that blended in the best in the wild was gray. In 1857, one of the first true uses of camouflage occurred when British soldiers dyed their white tunics and belts tan, or khaki (which means literally "dusty" colored), to blend in with the environment in India. The first section de camouflage in military history was established in 1915 by the French, under the command of an artist. Thereafter, comparable units were used by the British and Americans, and, to lesser extent, by the Germans, Italians, and Russians. These units were largely made up of camoufluerss who in civilian life had been artists of one kind or another, including fine artists, designers, and architects. As a result, participants on all sides of the conflicts used hundreds of artists during both World Wars. These artists acted as military or civil defense camouflage experts. Included in this group were such familiar names as Jacques Villon, Franz Marc, Arshile Gorky, Thomas Hart Benton, Grant Wood, Laszlo Moholy-Nagy, and Oskar Schlemmer.

Artificial camouflage patterns of some sophistication appeared in the 1914–1918 time frame propelled by advances in weapons and tactics that accompanied the First World War. Thayer designed some of these patterns. Others were designed by a variety of daring and empirical innovators. The designers tended to rely on bold disruption, deception techniques (e.g. painting a large bow wave on a slow vessel to deceive submarine observers as to their actual velocity and direction), as well as traditional blotch and splinter (sharp-edged, polygonal patterns) approaches.

While the wartime use of camouflage is by no means a modern invention, its importance became magnified during World War I because of the use of airplanes and aerial photography. The Korean War saw the introduction of night vision devices, which added the need to disrupt the human form not only in the visible but also in the near infrared range of the spectrum. Humans see a wide color spectrum called the visible range, and when aided by night vision devices, humans can also see into the near infrared range. The problem of disrupting the human form in both the near-infrared and visible ranges is only a military problem that has no parallel in the natural world. Adding to the complexity is that dry and wet conditions change reflectivity of surfaces changing the "hiding" characteristics of most patterns under different light conditions.

Interest in camouflage declined through the 1950s because of advances in fire control and target acquisition technology. Also, experience showed that most camouflage measures simply did not work very well. The visual system simply overpowered most measures.

In the late 1960's and 1970's, there was a resurgence of interest in camouflage. In the area of camouflaging combat vehicles, Sweden adopted a "splinter" pattern keyed to the colors predominant in Scandinavia. Germany experimented with novel boundary disrupting measures. Many countries simply applied camouflage as a matter of pride or decoration. Some of these designs had little practical counter-surveillance utility, but looked somehow "martial."

In the United States, the war in Viet Nam occasioned the issue of battle dress uniforms using a woodland color pattern that was designed by the U.S. Army Engineering Research and Development Laboratory as early as 1948. Though designed by the Army, it was rejected by that service and adopted instead by the Marine Corps. By the late 1970's, a general desert camouflage appeared for uniforms. By the middle of the 1970's, combat vehicles and other equipment acquired a four-color camouflage pattern designed by the U.S Army Mobility Equipment Research and Development Center (MERDC; now BRDEC). This pattern was widely used from 1974 until the 1980's, when it was replaced by a 3-color NATO standard pattern.

Camouflage Pattern

For the human form, camouflage is used by hunters and by the military. For hunters, it is sufficient to disrupt the human form with a pattern because many animals are colorblind so, it is only necessary to "blend" into the shades of gray created by the background of the terrain. Colors within that terrain are not as critical. For military applications, color is an additional issue that must be considered.

Two significant deficiencies common to most camouflage pattern measures is that most pattern measures address either the configuration of the target to be hidden, or the nature of the background into which the target must blend. This limits the usefulness and robustness of a concealment measure since both objectives must be answered if the target's signature is to be significantly reduced for the observer. There have been many approaches trying to address both camouflage patterns in general and military or paramilitary applications of camouflage in particular. The most common appearance of military camouflage are various forms of curving shapes in three to four natural "earth tone" colors. Hunter camouflage takes the form of a mimic of trees, bark or bushes. Mathews in U.S. Patent No. Des. 425,709 teaches a camouflage design in the form of bushes. Kolpin, in U.S. Patent No. Des. 297,076 shows a bark or rock like pattern. Yacovella in U.S. Pat. No. 4,656,065 teaches a pattern and color combination that mimics rough bark of a tree. Hollinger, in U.S. Pat. No. 5,675,838 carries this theme a step further by teaching two different patterns printed on one set of clothing to account for vertically and horizontally growing plant life. Lehman, in U.S. Pat. No. 5,972,479 describes a method of creating or forming these mimic camouflage patterns. The process includes photographing one or more environments, entering the photographs as graphics into a computer to create a composite picture, separating the colors in the composite picture into a series of color prints, creating screens for each major color, and finally rotary screen printing the composite onto sheet material. This technique is a standard printing process for fabrics in general and camouflage in particular. The issue with mimic patterns is that they are site specific or geographically limited.

For military applications, the mimic of a particular setting is inadequate. The military needs camouflage that will be adaptable in many different environments and under different weather conditions with the minimum number of uniform sets. In addition, the military needs a camouflage pattern that works well in the visible as well as in the near-infrared range of the spectrum when using night vision devices.

Many military patterns, on the other hand, ignore the nature of the background (except as regards gross color distributions), concentrating on the Thayer principle of disruption of boundaries. Each of these approaches is somewhat less than half the answer. Conway, in U.S. Pat. No. 5,077,101, describes camouflage for tanks and other vehicles by using a three-color paint that helps to mask infrared emissions. The paint relies heavily on the inclusion of carbon in the dye. Carbon can also be incorporated into the fiber itself for substrate or sheet material on which a camouflage pattern is printed. Such a process is described by Weingarten in U.S. Pat. No. 4,095,940, where carbon is incorporated into the fiber and the sheet material is then cross-dyed or over-printed with standard dyes that are compatible with that type of fiber as used in traditional camouflage patterns to provide adequate near-infrared protection properties. Clarkson, in U.S. Pat. No. 5,798,304, describes an interesting camouflage uniform for uniformed law enforcement that shows a solid color under visible lighting conditions and a camouflage pattern in the near-infrared range.

Conner in U.S. Pat. No. 5,985,381 took a different approach. Conner suggests a mimic type pattern (leaves of an eastern forest) coated with photochromic and/or heat sensitive materials so the printed pattern will change color under different light and temperature conditions.

One innovation appeared in 1976 that applied a more scientific spin explaining the reasons camouflage worked, O'Neill et al. (1977a,b). This innovation was called "Dual-Tex" or dual-texture. Initially, Dual-Tex was a modification of the MERDC 4-color vehicle pattern, where a band of higher, denser texture was added by the simple expedient of coarse quantization. This means that a larger pattern was decomposed into pixel-like square elements while keeping the larger element. This was like "adding leaves to trees" without removing the tree. The result was a macropattern that disrupted the shape of the target making it hard to recognize, and a micropattern that matches the texture of the background, making it hard to detect (hence "Dual-Texture"). These two elements address the two visual tasks that face an observer detecting a target against a background (technically, detecting an anomaly in the optic array), and then recognizing (or identifying) the anomaly as a target or a false alarm. These tasks are served by two more or less distinct visual pathways—the ambient (or tectopulvinar) and the focal (or geniculostriate). These have been described as the "where is it?" and the "what is it?" systems.

The Dual-Tex measure was subjected to test and evaluation at the United States Military Academy using photo-simulation techniques (O'Neill et al., 1977a), and at Aberdeen Proving Ground using human observers against painted test vehicles at tactically appropriate ranges (O'Neill et al., 1977b,c) The measure was tested informally in various locations, and in 1978 was adopted by the 2$^{nd}$ Armored Cavalry Regiment in Europe (where it continued in use until the adoption Army-wide of the current 3-color pattern). It was formally subjected to troop test by the Combat Development Experimentation Command shortly afterward (CDEC, 1979). An application of the Dual-Tex concept was published in the November/December 1977 issue of Armor Magazine.

Military patterns that address disruption of the target shape, as opposed to background match, concentrate on the boundary features of the target. This is a misconstruction of what constitutes the visual, as opposed to the physical features of the target. The Dual-Tex macro-pattern component, as an exception, evolved from a traditional boundary-disrupting configuration to a unique and more effective approach.

Blum (1967, 1973, 1974, 1978) demonstrated a new non-Euclidean geometry of biological form based on internal symmetries of shapes. Psotka (1978) showed that the observer's visual attention tends to lie along the symmetry axes of a shape rather than along the boundary or at the center (as traditionally assumed). O'Neill (1982) demonstrated the effect of a local interaction in the optic array that draws the attention of the observer, and may assist in recognizing and encoding shapes in the visual cortex. O'Neill (1986) modified the Dual-Tex pattern to include a macro-pattern keyed to the symmetry axes instead of the boundaries in a test of the effects of camouflage measures on the ability of a gunner to track a moving target. The combination of the target disrupting macro-pattern and the background-matching micro-pattern is the essential characteristic of the Dual-Tex type measure. No previously known or currently known camouflage pattern measure appears to address both these factors (disrupting the target and matching the background) effectively for a broad spectrum of terrain and environmental conditions needed for military operational effectiveness.

The micro-pattern of the Dual-Tex measure was designed to match the texture of the background in a tactical environment, defined as the spatial frequency spectrum. The micro-pattern matches the spatial frequency spectrum of the environmental background. It mimics the size components of the background. The role of spatial frequency in human vision and pattern recognition has been demonstrated experimentally since 1969 (e.g., Blakemore and Campbell, 1969; Julesz, 1980; Maffei and Fiorentini, 1980; Ginsburg, 1978, 1980). O'Neill (1988) demonstrated the role of spatial channels in detecting military targets. Dual-Tex pattern employs a quantization method to decompose a macro-pattern (q.v.) by the technique of digitizing the macro-pattern to add appropriate bands of spatial frequency "noise" that mimics the presumed tactical background.

The Canadian National Defense Force came to realize that it was not necessary to have curved sections of color to form a camouflage pattern. The Canadians designed and began fielding the Canadian disruptive pattern (CADPAT), which consists of shapes having relatively straight sides. Josephs, in U.S. Pat. No. 6,061,828, also suggests a camouflage pattern using what Josephs calls rectilinear shapes. Josephs relies on rather large splotches of color in at least six sided splotches with opposing sides being parallel to form a pattern. Josephs appears most interested in the "fashion" attraction of camouflage rather than its utilitarian application. The only advantage of straight-sided figures is that it simplifies computer printing. The US Marine Corps evaluated some 60 existing patterns in house. Field-testing revealed that none of the existing patterns provide maximum concealment possible given today's printing and material technologies as well as pattern concepts.

Fabric, Printing and Garment Treatments:

Historically, military uniforms were made of heavy cotton twill or duck fabric. This is also true of the modern fatigue or utility uniform. The heavier the fabric the more durable it was. These types of fabrics were hot to wear, became heavier when wet and were slow to dry. Cotton fabrics rapidly look like they were "slept in" even when heavily starched. Pure synthetic fibers had a good wear life and could be made permanent press, but the fabric tended to be hot and not adsorb sweat. In addition, many synthetic fibers reflected both visible and infra red light. In other words, synthetic fibers are shiny. Blending cotton with synthetic fiber, such as nylon, increases the fabric's strength without increasing weight. Uniforms and clothing made from these fabrics wear better than those made from the traditional 100 percent cotton fabrics. They also have advantages of drying rapidly, and maintain a sharp military appearance longer. Finding the correct balance of fiber composition, weave, weight, and ability to take the needed dyes was a complicated empirical problem.

Printing, represents another challenge. While there are numerous types of dyes and pigments, all of which are chemically compatible with specific fiber types, they can not be used interchangeably. Each different class of dye also has certain performance characteristics. Acid dyes are compatible with nylon fiber and are very colorfast, but in the near infrared, generally, they are too light and bright for military camouflage purposes. Vat dyes are used to dye cotton fabrics. They are very colorfast, but in the near infrared, generally, they are too dark. Disperse dyes are compatible with polyester, however, they are not available in the colors required to meet military camouflage specifications, they are not very colorfast, and they are light and bright in the near infrared.

Hodge et al., in U.S. Pat. No. 5,074,889, teaches a method and describes materials for printing aromatic polyamide (aramid) fabrics with acid dyes. The treatment is specifically designed to print or overprint the sheet material with an acid dye for camouflage patterns. A problem still remains. The problem is achieving the objectives of a durable, serviceable uniform with concealing characteristics in the visible and near infrared. The problem requires a disruptive pattern that can be used for a wide range of applications from paint patterns on tanks, through uniforms that is an improvement on the good beginning of the prior art.

SUMMARY OF THE INVENTION

Accordingly, an object of this invention is the creation of a camouflage pattern measure based on the functioning of the human visual system, addressing both disruption of the subject target shape and matching of the spatial characteristics of the environment.

Another object of the invention is a pattern which is empirically developed and subsequently defined by a mathematical algorithm that is optimized for different environments by computer aided devices.

A further object of this invention is a pixel pattern that provides improved disruption of a subject over existing patterns.

Yet another object of this invention is the creation of a camouflage pattern printed on a surface such as fabric of uniforms and equipment or combat vehicles that will provide improved concealment in both visible and near-infrared range of the electromagnetic spectrum.

A further object of this invention is integrating the fabric, acid dyes and overprinted vat dyes, and functional finishes together with a specific empirically derived pixel pattern providing improved results in the visible and near-infrared spectrum range for fabric based subjects.

Yet another object of the invention is a camouflage pattern which gives effective camouflage results under both wet and dry conditions.

A further object of this invention is a system resulting from a combination of materials, dyes, printing methods, pattern and design features relating specifically to uniform design that builds a "system" which provides U.S. Marines a combat utility uniform with significant advantages over currently available similar systems.

A further object of this invention is a fabric that provides improved camouflage advantages when combined with specific dyes and printed in a specific pattern.

Again, an object of this invention is a human engineered uniform having improved wear characteristics and improved protective protection for the user.

These and additional objects of the invention are accomplished by a camouflage system to be used for both military uniforms and equipment. Also, the system can be used for civilian applications, particularly with sportsman hunters. The system provides camouflage in both the human visible light range and the infrared light range. The system depends on the use of a macro-pattern resulting from a repeat of a micro-pattern. On fabric, the results are achieved by printing a macro-pattern that disrupts the sensed shape of the subject and a micro-pattern that blends the subject into the background. The repeat size of the micro-pattern produces the macro pattern. The reflectance of the printed material is comparable to the negative space surrounding a subject so the subject does not appear too dark or too light (out of place). The variation in the lightness between wet and dry printed fabric is not greater than 17–28%. The fabric can be formed into uniforms and other fabric equipment.

BRIEF DESCRIPTION OF THE DRAWINGS

A more complete appreciation of the invention will be readily obtained by reference to the following Description of the Preferred Embodiments and the accompanying drawings in which like numerals in different figures represent the same structures or elements. The representations in each of the figures are diagrammatic and no attempt is made to indicate actual scales or precise ratios. Proportional relationships are shown as approximates.

DESCRIPTION OF THE PREFERRED EMBODIMENTS

Figure 1:
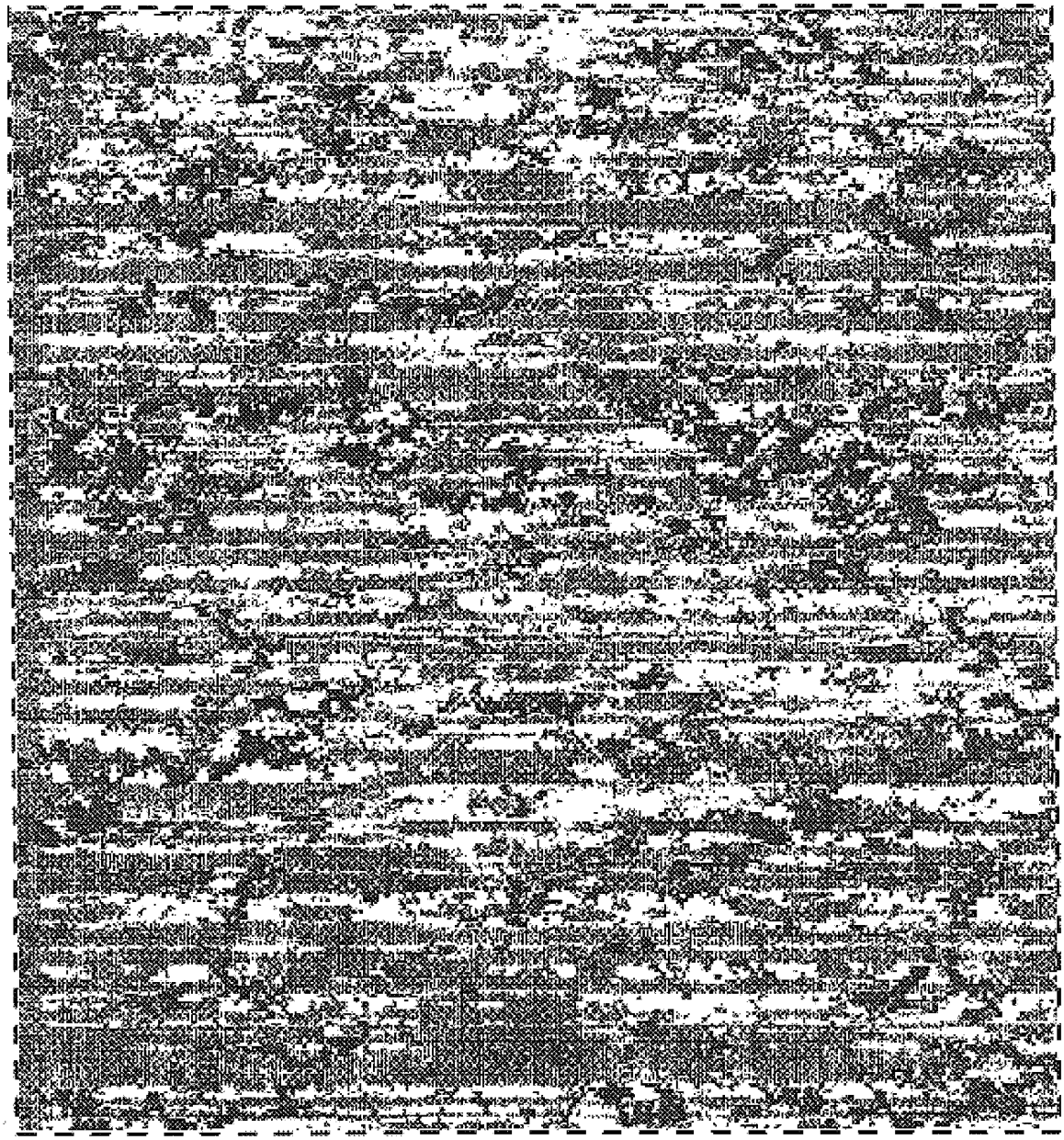
FIG. 1 is a plan view of the camouflage pattern of this invention applied to at least one surface of sheet material showing a single repeat of the ornamental design. The pattern is independent of the colors used in the design. The broken lines depict the boundaries of one repeat unit of the ornamental design. The design continues indeterminately in one or more directions. Each repeat is approximately 36"× 36". This size is based on the approximate size needed to avoid an appreciable repeat of the pattern on the individual subject when the pattern is used for clothing.

Through focus group discussion and feedback to the uniform board, the United States Marine Corps (USMC) found that the current curved style camouflage patterned uniform was inadequate for color, pattern, and durability of the fabric. The same inadequacies applied to equipment of all types including vehicles, tents etc. The camouflage pattern and colors in use at the time were developed in the late 70's at which time the designated threat areas were considerably different than today's threats. Additionally, there were other problems. The current uniform and fabric equipment becomes very dark when wet. This is an issue that concerned many Marines because the change in color can markedly change the hiding ability of the disruptive pattern. If a camouflage pattern doesn't break up the pattern of the human body or other subject and aid in matching the background texture of its surroundings, the subject will appear as a black silhouette against the background. This is one of the primary shortcomings of the current system. Preferably, the same pattern and design principals are applicable to camouflage whether applied to clothing or a tank. The invention will be illustrated by reference to uniforms.

When the US Marine Corps began to consider designing and improving the camouflage it currently uses, the USMC realized that more was needed to maximize the utility of a new combat uniform than just a more distinctive pattern. There is a need for an integrated approach to obtain the maximum benefit of the synergistic inter-relationship between pattern, materials used, printing and painting techniques and procedures to obtain complete battlefield concealment in the visible and near infrared spectrum.

The USMC began its design efforts by studying the camouflage designs, currently used worldwide. Over 60 commercial camouflage patterns and uniforms were evaluated in the U.S. Army, Soldier Biological and Chemical Command, Natick Soldier Center's Camouflage Evaluation Facility, S-136 (Natick). The selected patterns were evaluated for effectiveness in the visual and near infrared range (using night vision goggles) in a laboratory setting simulating actual woodland, desert and urban settings. Three trained and experienced camouflage technical observers conducted the evaluation using a seven-point scale (7-most effective). The evaluation included both pattern and color(s). Based on this initial evaluation, eight potential candidates were down selected. Because of other factors, this selection was further narrowed down to the three best performers called Tiger Stripe pattern, CADPAT (Canadian Pattern), and Rhodesian pattern. After extensive laboratory analysis and testing, a variation of the CADPAT pattern, empirically modified by the artistic interpretation and visual experience of well trained and seasoned Marine Corps Scout Snipers was selected and designated as MARPAT (Marine Corps Pattern.).

After initial selection, these three patterns were further enhanced using software applications to optimize and enhance effectiveness. These modifications we empirically analyzed by testing as described above and were first printed on paper for further evaluation. Once optimized, two patterns were selected for print on actual material and taken for field evaluation (MARPAT and Tiger stripe). This procedure permitted continuous and frequent changes to maximize pattern effectiveness without the cost and time necessary to print each iteration on cloth. The final camouflage patterns were printed on the appropriate textile substrate for more detailed laboratory and field testing with the Marine Corps Scout Sniper School and other subject matter experts from the Marine Operating Forces.

The pattern itself is a part of this invention. Where war fighting is not necessary or when applied to hardware, the pattern stands alone. Where war fighting is necessary, the pattern, when applied to fabric, could be combined with specific dyes and printing procedures to extend disruption into the near infrared. The invention is applicable to all aspects where camouflage is needed to disrupt the visualization of a subject such as painting vehicles, making tents, tarpaulins, and painting or covering stationary equipment as well as clothing. The preferred embodiment illustrated in this invention is the USMC field combat utility uniform and particularly the blouse and pants of the combat utility uniform with its accessory boots and hat.

MacroPattern/Micro-Pattern

The inventors found that while camouflage patterns can be described by mathematics after the fact, it is not possible to design a pattern by formula alone. The general principals taught by O'Neill require a macro-pattern and a micro-pattern. The macro-pattern is based on the shape of the potential subject to be camouflaged, and is independent of environmental or background characteristics (except for selected color palette). The purpose of the macro-pattern is to disrupt recognition of the shape characteristics of the subject.

Shape derives, not from the boundary of the shape (B-morphology) of the subject, but from the symmetry axes (A-morphology). The symmetry axes are internal, skeletal "stick figures" that are unique and fully reversible: that is, information defining the symmetry (symmetry axis and symmetry distance) axes can be used to define the shape that generates them. Once the symmetry axes have been defined, the designer can proceed to generate a macro-pattern intuitively by inserting irregular bands and patches that interrupt the symmetry axis components of the subject. These bands or patches are formed from blocks of color. The size of the macro-pattern elements will depend on the size of the symmetry-axis elements. The macro-pattern does not have to be formed from solid blocks of color but can be formed from smaller elements called pixels that are grouped into variations of color that form a block of textured color that forms the macro-pattern.

In the simplest sense, the micro-pattern is a systematic decomposition of the larger macro-pattern elements into pixels that match the optel sizes of the optic array. This means that a given tactical environment is composed of a band of textures of various sizes (and colors). These can be defined as optels, or optic elements. An optical element is a basic unit of reflected light that cannot be practically broken down further in a way that is meaningful to the eye or a sensor. Of course, this theory is more usable on fixed forms, such as tanks, trucks etc. When applied to uniforms (clothing) design becomes more difficult because the shape is always changing as a subject moves.

The micro-pattern can be established by first deciding on a base pixel size. This is a judgment determination made on the basis of the subject size and the distance from which the subject will be observed. Obviously, there is a pixel size too small to be resolved at tactical distances. For example, a uniform for an individual subject will have a base pixel size that is relatively small because detection distances will be smaller because of the tactical environments in which a subject operates. A large vehicle will as a matter of practicality be hidden against detection and recognition at much longer ranges and can thus get by with a larger base pixel size. The pixel shape may be almost anything that mimics the environment. For uniformity and simplicity of generation, the familiar rectangular, including square, pixel is preferred. The square shape (rare in nature) will not be detectable if the base pixel size is kept small enough to avoid being conspicuous.

In the ideal environment the micro-pattern is developed by a survey that defines the bands of optel size that must be modeled. The simplest method for such a survey is photographic images digitized and subjected to Fast Fourier Transform (FFT), a mathematical method (in this case) for decomposing the image into its spatial components and the spatial frequency power spectrum. The segment of the highest frequency peak has the smallest pixel. It is important to note that color attributes (chromaticity and contrast) are independent of the pattern. The pattern configuration can theoretically be used for any optic array, no matter the color properties. It is also essential to understand that the choice of rectangular pixels to represent the infinite number of optel shapes is arbitrary and based on the ease of digitally decomposing images into rectangles or squares. It is only necessary that the pixel shape be the correct size to mimic the spatial properties of the background of the subject.

The edges of the pixel shape must be sharply defined because much high-spatial frequency information resides in edges of the shape than in the shape itself. Based on extensive testing, USMC selected a pixel for uniforms of rectangular shape at the pixel (optel) level between 1 to 1.5 square millimeters forming the macro pattern effect measured at between 130 to 150 square millimeters and 8 to 12 square millimeters. Paint arrangements for tanks, trucks etc. are proportional. Pixels are approximately 4–5 mm (1/16 of an inch) that when agglomerated into groups, make up an overall pattern of irregular, rectangular shapes in size and configuration matching the spatial properties of the presumed tactical environment. Although these shapes have relatively sharp edges, the line can be jagged and not long straight lines. These jagged edges are illustrated in FIG. 1.

Figure 10:
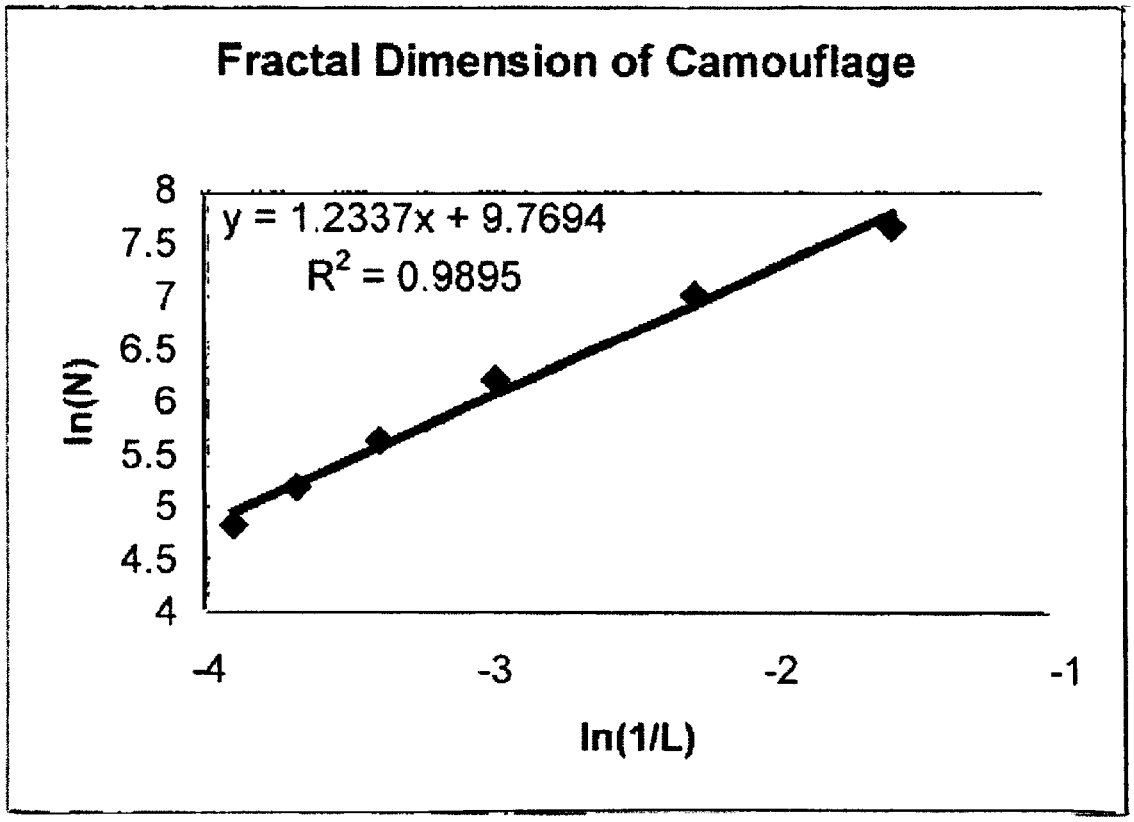
FIG. 10 is a graph titled Fractal Dimensions of Camouflage.
Figure 11:
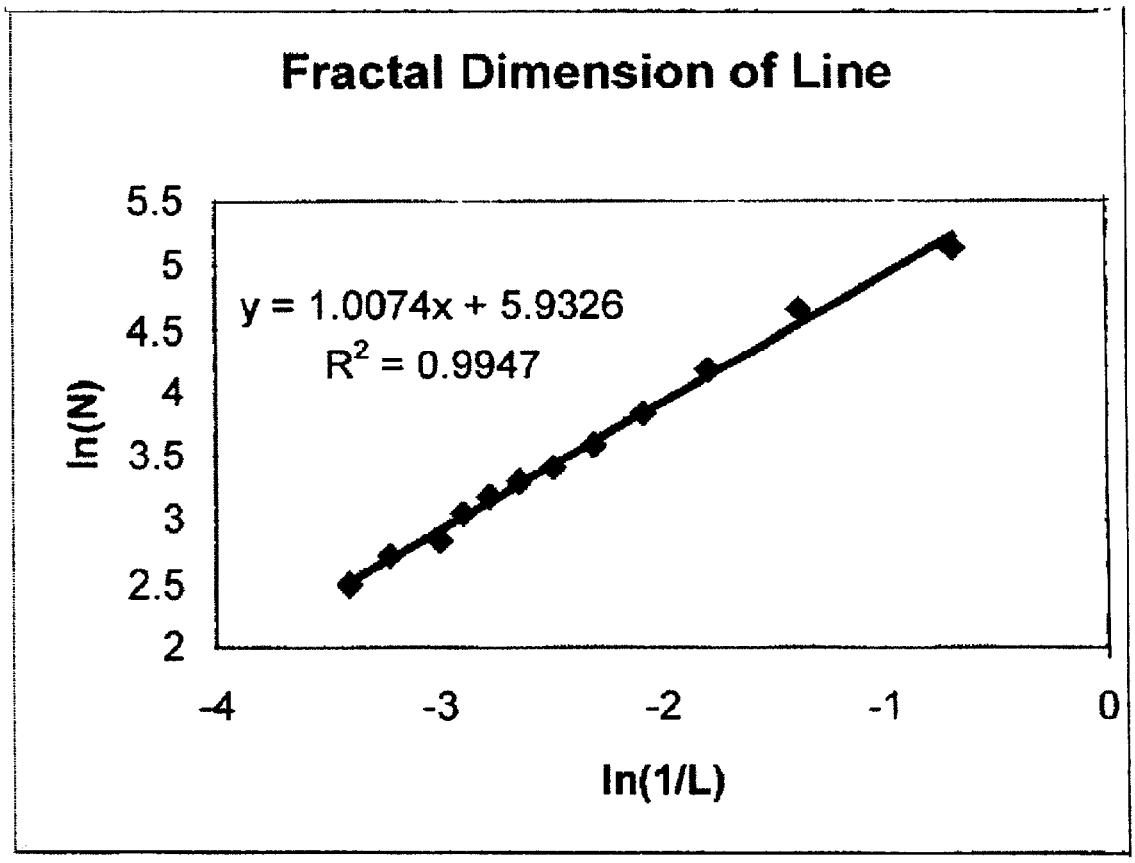
FIG. 11 is a graph titled Fractal Dimension of Line.

These rough jagged lines can be measured in terms of a fractal dimension or its texture (roughness or jaggedness). The fractals are described in Charts I & II and FIGS. 10 & 11. Creating color patches whose roughness (texture) matches the roughness (texture) of the background will provide better concealment than matching only the percentage of each color. The length of a smooth straight line remains constant as you change the length of a ruler used in the measurement. That is, if you cut the length of the ruler in half you will need to lay it down twice as many times to reach the end of the line. However, if the line is not smooth but is irregular and jagged, its measured length will depend on the length of the ruler used. The shorter the ruler length the more closely you can follow the exact contour and thus the line appears to be longer. One measure of the roughness line is its fractal dimension, D, where D=ln(N)/ln(1/L) and N is the number of times a ruler of length L must be applied to traverse a span or line. If N is measured for several values of step size, L, the slope of the linear portion of the line ln(N) versus ln(1/L) is the fractal dimension, D; the limits of the linear region mark the ends of the length scale for which the object appears rough. For a two-dimensional object having a rough jagged boundary, the fractal dimension for some range of L will be between 1.0 and 2.0. A rough calculation of the fractal dimension of this new camouflage and of the fractal line was developed and is recorded below in Charts I & II. The program puts a grid of squares of size L over the pattern and counts the number of squares (N) containing a piece of the pattern edge. Repeating for several grid sizes produces a fractal dimension (slope of the line ln(N) vs. ln(1/L)) of 1.23

| L | N | In(1/L) | In(N) |
|---|---|---|---|
| | | Chart I | |
| 50 | 123.87 | −3.91202 | 4.819233 |
| 40 | 178.15 | −3.68888 | 5.182626 |
| 30 | 279.2 | −3.4012 | 5.631928 |
| 20 | 499.94 | −2.99573 | 6.214488 |
| 10 | 1111.67 | −2.30259 | 7.013619 |
| 5 | 2119.2 | −1.60944 | 7.658794 |
| | | Chart II | |
| 30 | 12 | −3.4012 | 2.484907 |
| 25 | 15 | −3.21888 | 2.70805 |
| 20 | 17 | −2.99573 | 2.833213 |
| 18 | 21 | −2.89037 | 3.044522 |
| 16 | 24 | −2.77259 | 3.178054 |
| 14 | 27 | −2.63906 | 3.295837 |
| 12 | 30 | −2.48491 | 3.401197 |
| 10 | 36 | −2.30259 | 3.583519 |
| 8 | 46 | −2.07944 | 3.828641 |
| 6 | 65 | −1.79176 | 4.174387 |
| 4 | 105 | −1.38629 | 4.65396 |
| 2 | 170 | −0.69315 | 5.135798 |

Figure 2:
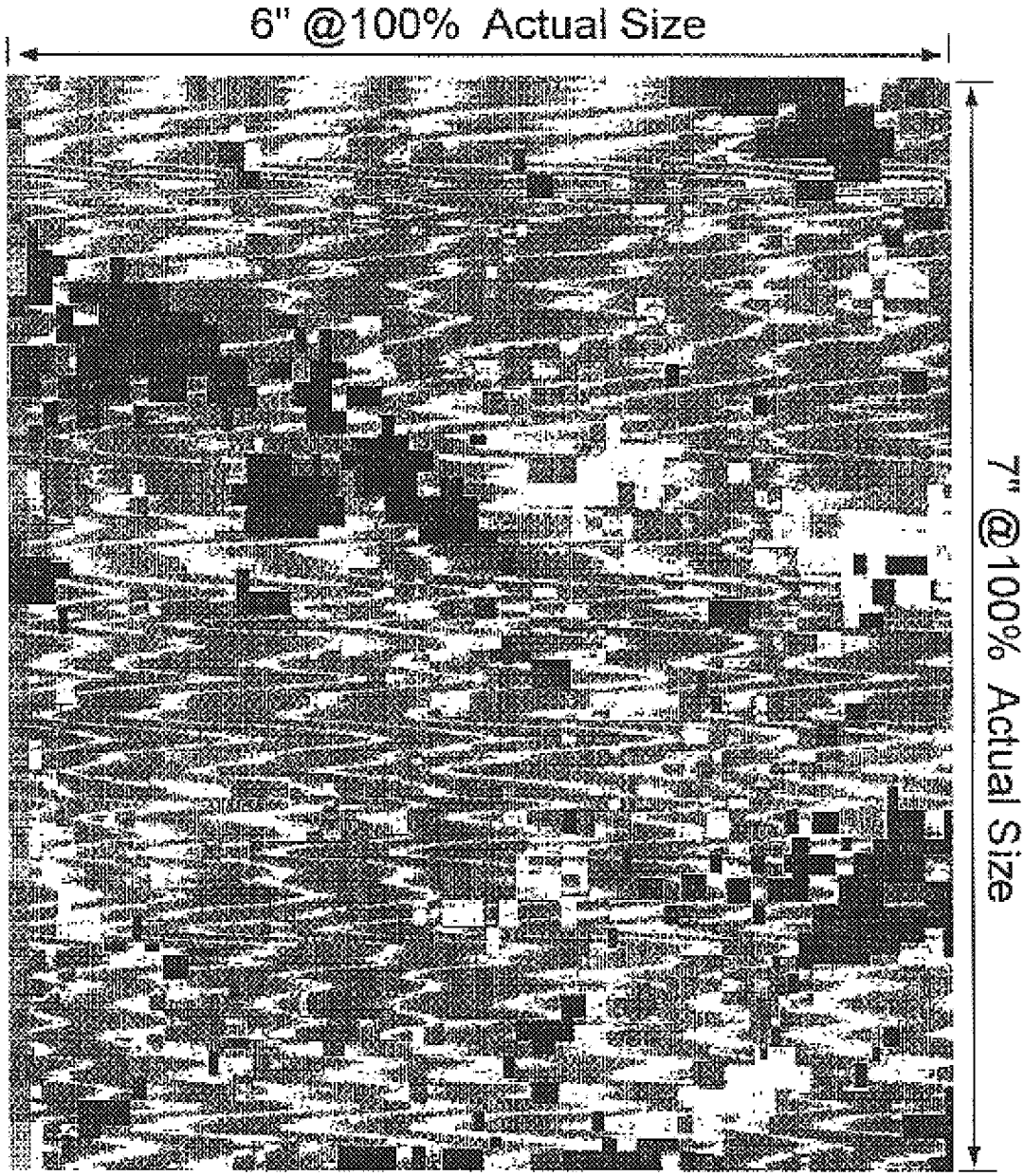
FIG. 2 is a section of the repeat of FIG. 1 at full scale showing the inclusion of the U.S. Marine Corps Eagle Globe and Anchor symbol (EGA).
Figure 3:
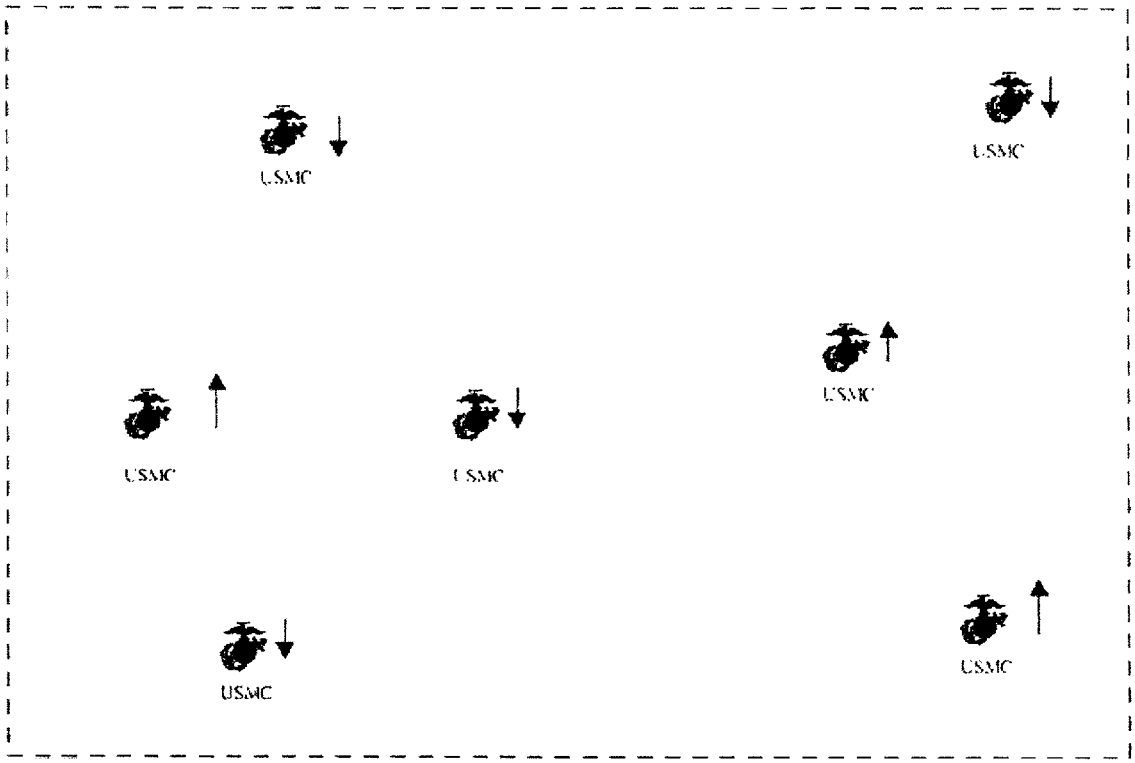
FIG. 3 is a plan view of one repeat of the sheet material of this design showing the distribution of the Eagle, Globe and Anchor. At least seven (7) EGA logos are distributed in each repeat. For clarity, the camouflage pattern is not shown.

The preferred pattern is shown in FIG. 1. FIG. 2 shows a detail, in full scale, of FIG. 1. The US Marine Corp Eagle Globe & Anchor (EGA) insignia is incorporated into the printed fabric of the USMC uniform. FIG. 3 is a detail showing placement of the EGA for an example of the placement of seven EGA. Of course, more EGA can be used. In FIG. 3, the pattern is not shown for clarity. The impact of this pattern/color placement at a distance (that is, combination of macro-pattern and micro-pattern visually resolved) is the formation of macro-pattern blotches that interrupt the structural symmetries of the human form. The orientation of the pixels is not critical. They could just as well be vertically aligned or horizontally aligned.

Color and Ration of Light to Dark

The colors used are independent of the pattern configuration, except that the percentage of base pixels of a given color should approximately match the percentage of optels of those colors in the tactical environment. It is practical to use the same pattern that is empirically derived and just vary the colors used to match the predominant colors of the environment. It is also possible to use image analysis techniques to define sub configurations based on the physical characteristics of the environment, but this is not necessary in most cases, and might lead to nonproductive excursions into artistic mimicry. Color choices should be based on the tactical environment, not the geographic environment. To be effective, a camouflage pattern must be designed and developed to be used in a specific environment and the primary zone(s) of operation or potential threat areas must be identified. This is critical for selecting the disruptive pattern most effective for that zone and, most importantly, selecting the colors/shades that work best in that environment. Sand, concrete, asphalt, dirt, rocks, bark, leaves, and shadows make up the vast majority of the terrain in which a Marine will be required to operate. Each of those elements has certain color and spectral reflectance values, measured in percent reflectance. This percent reflectance must be considered when selecting the appropriate colors dyestuffs and associated reflective properties for designing/selecting the colors of a camouflage pattern.

From a tactical standpoint, nature is viewed in terms of positive and negative space. One must keep in mind negative versus positive space and its influence on camouflage and its deception characteristics. Positive space is defined as the solid objects in nature such as rocks, trees, etc. which are primarily vertical lines. Negative space is described as the "empty" space or the color surrounding the solid objects or resembling horizontal lines. USMC Scout Snipers are trained to differentiate between positive and negative space in nature. Based on experience, the snipers feel that the best camouflage resembles negative space and does not necessarily match the surrounding objects exactly. A good example is a gray fox that resembles the space around solid objects. The objective is to develop a camouflage system whose colors and pattern resemble negative space another words, not anything specific found in that particular environment.

The focus is to develop a camouflage system that will be most effective in both the visible and near-infrared range under wet and dry conditions. Applying the principals described above, the USMC selected the colors that are usable in a variety of terrain. The USMC determined three different color pattern schemes would work for most environments for a utility uniform. The colors systems are designates Woodland pattern composed of shades of coyote, green, black and khaki, Desert color pattern composed of shades of light coyote, urban tan, desert light tan and highland and Urban pattern composed of shades of black, medium and light gray and coyote. The pattern for all three of the color schemes is the same, i.e. the MARPAT pattern. The selected colors are chosen to provide superior camouflage for any zone of operation having a general environment designated Woodland, Desert or Urban regardless of where in the world that environment is found.

Empirically, it was determined that the optimum camouflage system effective in both the visible and near-infrared ranges for fabric and provides the best colorfastness properties, is a 50/50 cotton nylon fabric dyed using acid class of dyes and then overprinted using rotary screen printing technology with either three or four screens. Basically, one color is the base color and one screen is used for each color using selected dyestuffs. Of course, if the base shade is used as one of the four colors that shade should be the lightest of the four. Color names and numbers identify the specific color and shade. While the full pattern repeat is the same for Woodland, Desert and Urban, the difference between them (as visually depicted in FIGS. 1 & 2) is the distribution, location and percentage within the pattern repeat of each of the four colors selected especially for each spectrum of operations, based on their performance within that operational environment. In the optimization process, the best results were achieved when mixing the appropriate amounts of Acid Blue 258 and Tectilon Orange GV4R to dye the ground shade and when selecting the proper color combinations of Vat Yellow 2, Vat Green I, Vat Brown 57 and Vat Orange 6 along with small amounts of Sulfur Black 6, it provided the required visual and near-infrared reflectance and colorfastness performance critical to military items. By mixing the appropriate amounts of the dyestuffs stated above, one will be able to closely achieve the desired CIELAB values for each color in the relevant terrain. Color is expressed using the universally known CIELAB system. Each color is characterized in terms of L* a* b* values where L* represents the lightness coordinate, a* represents its red-green variation, and b* represents its blue-yellow variation. Every color has its own unique set of L* a* b* values, similar to a fingerprint. The CIE L* a* b* values for the camouflage colors for woodland, desert, and urban terrains are listed in Table 1 below:

TABLE 1

"CIELAB Measurements"

| | CIELAB Measurements | | |
|---|---|---|---|
| | L* | a* | b* |
| Woodland Camouflage Colors | | | |
| Green 474 | 24.93 | −3.80 | 4.06 |
| Khaki 475 | 45.07 | 0.60 | 12.94 |
| Coyote 476 | 33.42 | 3.26 | 10.08 |
| Black 477 | 15.42 | 0.79 | −1.25 |
| Desert Camouflage Colors | | | |
| Urban Tan 478 | 53.57 | 4.51 | 12.16 |
| Desert Lt. Tan 479 | 59.22 | 2.90 | 9.28 |
| Highland 480 | 33.42 | 5.70 | 15.36 |
| Lt. Coyote 481 | 44.26 | 4.48 | 16.41 |
| Urban Camouflage Colors | | | |
| Coyote 476 | 33.42 | 3.26 | 10.08 |
| Black 477 | 15.42 | 0.79 | −1.25 |
| Lt. Gray 4S6 | 60.71 | 2.22 | 5.13 |
| Medium Gray 487 | 43.86 | 1.36 | 2.89 |

Lightness and reflectance are interrelated. Color is measured in terms of lightness (brightness of a color, i.e. light red), chroma (dull red vs. bright red) and hue (color itself, i.e. red). These three components make up the reflectance factor of a color. When the lightness value of a color is measured, the light reflected or brightness of an object as compared to another object is what is being measured. Chroma or hue are not considered in this calculation. While the reflectance factor of a material is the absolute value of light reflected for a material at each wavelength in the entire electromagnetic spectrum and it takes into consideration all three components of a color; lightness, chroma and hue.

The ratio and placement of dark to light are critical factors that need to be considered in producing an effective camouflage pattern. The darkest color for Woodland is black 477, the next lightest is green 474, then coyote 476, and the lightest is the base color khaki 475. For Desert, the colors are highland 480, light coyote 481, urban tan 478 and desert light tan 479, and for Urban the colors are black 477, Medium Gray C3 487, Coyote 476 and Light Gray 486 in increasing order of lightness. These colors are made by combining appropriate acid and vat dyes as specified above to provide the desired colorfastness and near-infrared reflectance properties required by military combat clothing users.

During discussions with focus groups, the degree of darkness of the current Combat Utility Woodland Uniform when wet was identified as a problem that needed to be addressed when developing a new Combat Utility for a Woodland Terrain. The respondents indicated that the "current cammies are too dark when wet". The darkness or lightness of a material is described scientifically in terms of its lightness value. All colored materials are arranged in color space by their order of lightness, from pure black or "0" value, to pure white or "100" value. All colored materials fall within that range with neutral gray tones measuring in the "50" range. The lightness value or L* can be measured by the use of a spectrophotometer. Typically dark colors such as black, dark green, and brown have a L* value below 50 and closer to zero on the lightness scale, while lighter colors such as khaki and light green have a L* closer to 50 or higher. Accordingly, the colors selected for the new combat camouflage pattern for a woodland background must have lightness values that are greater than the current combat camouflage pattern and more closely approximating the lightness value of earth in the zone of operation of interest. Consequently, when comparing the degree of lightness between the current woodland camouflage combat utility and the new MARPAT utility in the Woodland color combination, the following factors should be considered; first, the lightness values of each color and second, the percent of each color in the pattern. Table 2 below compares both the percent color and lightness values for each color under both dry and wet conditions in a woodland terrain:

TABLE 2

Lightness Comparison Between Current Combat Utilities & MARPAT Utility Uniforms

| Current Combat Utilities | | | | MARPAT Combat Utilities | | | |
|---|---|---|---|---|---|---|---|
| | Percent | Lightness value L* | | | Percent | Lightness value L* | |
| Color | Color | Dry | Wet | Color | Color | Dry | Wet |
| Black | 16 | 17.24 | 15.07 | Black | 18 | 17.67 | 14.58 |
| Brown | 34 | 25.53 | 20.28 | Green | 30 | 30.47 | 25.03 |
| Dark Green | 30 | 31.26 | 25.62 | Coyote | 47 | 38.67 | 30.22 |
| Light Green | 20 | 41.82 | 35.62 | Khaki | 5 | 47.14 | 40.56 |

When comparing the Lightness values for the colors of each pattern, we can see that the MARPAT colors, except for the black in the wet state, have lightness cl values higher than the current combat utilities in both dry and wet conditions, thus appearing lighter to the naked eye. In other words, 82% of the colors in the MARPAT are originally lighter (dry state) than the colors in the current combat utilities, which will in turn reflect as being lighter when wet.

In addition to the laboratory testing, field-testing was also performed to determine the effectiveness of the current standard combat utility against the MARPAT combat utility under wet (rain) conditions. Under both unaided (naked eye) and aided (binoculars) conditions, the MARPAT performed far superior to the current standard uniform. Both laboratory and field-testing data showed that the colors selected for the new Woodland camouflage pattern provides a significant improvement in terms of "color darkness/lightness" when wet over the current standard camouflage pattern. Lightness (L*) values for both the Desert and Urban camouflage colors are listed below in Table 3.

TABLE 3

Lightness Values for Desert and Urban Camouflage Colors

| MARPAT Urban Combat Utilities | | | | MARPAT Desert Combat Utilities | | | |
|---|---|---|---|---|---|---|---|
| | Percent | Lightness value L* | | | Percent | Lightness value L* | |
| Color | Color | Dry | Wet | Color | Color | Dry | Wet |
| Light Gray 486 | 47 | 60.71 | 53.99 | Lt Tan 479 | 47 | 60.65 | 51.19 |
| Medium Gray 487 | 30 | 43.86 | 36.84 | Urban Tan 478 | 30 | 54.28 | 46.02 |
| Coyote 476 | 18 | 41 | 32.47 | Lt Coyote 481 | 18 | 43.7 | 39.85 |
| Black 477 | 5 | 17.67 | 14.58 | Highland 480 | 5 | 34.1 | 29.9 |

Fabric and Texture

To meet this goal of a single uniform and address the durability deficiency of prior uniforms, a new uniform blouse fabric was developed. The preferred fabric is made of approximately 50+/−5% polyamide (nylon type 6,6 manufactured by Dupont as type 420, with a denier per filament of between 1.6–1.8), with the remaining percentage combed cotton. Other cellulosic fibers such as Lyocell can be used instead of cotton. The preferred weave is left-hand twill or twill derivative, though other weaves may be used. The preferred weight is 6.0–6.6 oz/yd$^2$. The trouser is made of a heavier temperate weight fabric. The new lightweight blouse, and heavier weight trousers provide the USMC with a combat utility uniform that has increased durability as compared to the current utility uniform and maintains the same level of comfort.

The fabrics were developed and selected based on their durability and comfort properties, as well as their ability to be dyed and camouflage printed. Only polyamide (nylon) fibers are chemically compatible with acid dyes, and cotton is chemically compatible only with vat dyes. While alone each fiber and dye combination will not provide the desired near infrared performance, together they synergistically provide the desired performance. This specific blend of 50% polyamide and 50% cotton fiber dyed by chemically compatible acid and vat dyes is the only known combination that provides the optimum colorfast performance and desired camouflage protection in the visible and near-infrared range.

Existing polyamide blend combat uniform fabrics do not provide durable electrostatic dissipation protection. As an alternative to plain polyamide fiber, a fine denier carbon core polyamide sheathed fiber or other electrostatic dissipating fibers are added to the fiber blend resulting in a total of 1 to 5% electrostatic dissipating fibers. This fabric will provide electrostatic dissipating protection for the life of the garment.

Dyes

The fabric is primarily selected for its durability and comfort properties as well as its ability to be dyed/printed to meet the selected colors/shades that need to be colorfast and effective in the visible and near-infrared ranges of the spectrum. The selection of acid and vat dyestuffs is critical in order to meeting the percent reflectance values shown in Tables 4–6 (Woodland, Desert, Urban, respectively) at the wavelengths specified for the colors in the camouflage pattern for that particular terrain. As an example that can be discerned from the following tables, black has a maximum reflectance value of 10 percent at wavelengths of 600 to 860 nanometers.

TABLE 4

Woodland Camouflage

| Wavelength | Black 477 | | Coyote 476 & Khaki 475 | | Green 474 | |
|---|---|---|---|---|---|---|
| (Nanometers) | Min. | Max. | Min. | Max. | Min. | Max. |
| 600 | — | 10 | 8 | 18 | 3 | 10 |
| 620 | — | 10 | 8 | 18 | 3 | 10 |
| 640 | — | 10 | 8 | 18 | 3 | 9 |
| 660 | — | 10 | 8 | 18 | 3 | 12 |
| 680 | — | 10 | 10 | 22 | 3 | 14 |
| 700 | — | 10 | 18 | 33 | 5 | 18 |
| 720 | — | 10 | 22 | 45 | 7 | 20 |
| 740 | — | 10 | 30 | 55 | 12 | 28 |
| 760 | — | 10 | 35 | 65 | 18 | 36 |
| 780 | — | 10 | 40 | 75 | 26 | 44 |
| 800 | — | 10 | 45 | 80 | 34 | 52 |
| 820 | — | 10 | 50 | 86 | 42 | 60 |
| 840 | — | 10 | 55 | 88 | 53 | 68 |
| 860 | — | 10 | 60 | 90 | 56 | 74 |

The reflectance Values (Percent) for desert colors are shown in Table 5 and for Urban colors in Table 6.

TABLE 5

| Wavelength | Desert Camouflage | | | | | |
|---|---|---|---|---|---|---|
| | Lt Tan 479 | | Lt Coyote 481 & Highland 480 | | Urban Tan 478 | |
| (Nanometers) | Min. | Max. | Min. | Max. | Min. | Max. |
| 700 | 38 | 53 | 19 | 41 | 25 | 44 |
| 720 | 38 | 54 | 20 | 41 | 25 | 45 |
| 740 | 39 | 55 | 20 | 42 | 25 | 46 |
| 760 | 40 | 56 | 21 | 42 | 26 | 47 |
| 780 | 41 | 57 | 21 | 42 | 27 | 48 |
| 800 | 43 | 58 | 22 | 43 | 28 | 50 |
| 820 | 45 | 59 | 23 | 45 | 30 | 52 |
| 840 | 48 | 62 | 24 | 46 | 33 | 55 |
| 860 | 50 | 65 | 25 | 48 | 36 | 58 |

TABLE 6

| Wavelength | Urban Camouflage | | | | | |
|---|---|---|---|---|---|---|
| | Black 477 | | Coyote 476 & Med Gray 487 | | Light Gray 486 | |
| (Nanometers) | Min. | Max. | Min. | Max. | Min. | Max. |
| 600 | — | 10 | 8 | 16 | 25 | 35 |
| 620 | — | 10 | 8 | 18 | 25 | 35 |
| 640 | — | 10 | 10 | 18 | 25 | 36 |
| 660 | — | 10 | 10 | 18 | 26 | 36 |
| 680 | — | 10 | 10 | 20 | 26 | 38 |
| 700 | — | 10 | 12 | 20 | 26 | 37 |
| 720 | — | 10 | 13 | 23 | 28 | 39 |
| 740 | — | 10 | 13 | 25 | 29 | 42 |
| 760 | — | 10 | 20 | 27 | 30 | 42 |
| 780 | — | 10 | 23 | 33 | 26 | 45 |
| 800 | — | 10 | 23 | 35 | 34 | 47 |
| 820 | — | 10 | 25 | 35 | 42 | 49 |
| 840 | — | 10 | 27 | 40 | 43 | 53 |
| 860 | — | 10 | 30 | 45 | 45 | 55 |

The requirements for reflectance properties for both Desert and Woodland are well established based on extensive data acquired for over two decades on elements found in those type of environments. The reflective values stated in Table 6 on the urban colors are based on limited data gathered on urban elements such as concrete, rocks, asphalt, etc. Limited amounts of fabric printed in Urban colors have been prepared and tested confirming that the same pattern (MARPAT) works well in any color combination.

Other fiber types and blends do not provide the durability and colorfastness properties obtained with acid and vat dyes and do not provide the same level of visual and near-infrared camouflage protection. Other colorants or dyestuffs such as pigments, direct dyes, fiber reactive dyes, etc. could be used but would not provide the critical reflectivity and colorfastness properties needed in military clothing items. For instances, pigments are widely used in the commercial market to dye and print textiles, but their reflection curves are very low, mimicking very dark areas. These same pigments have a "wash and crock fastness" properties inferior to the vat and acid dyes.

Utility Uniform Embodiment

Figure 4:
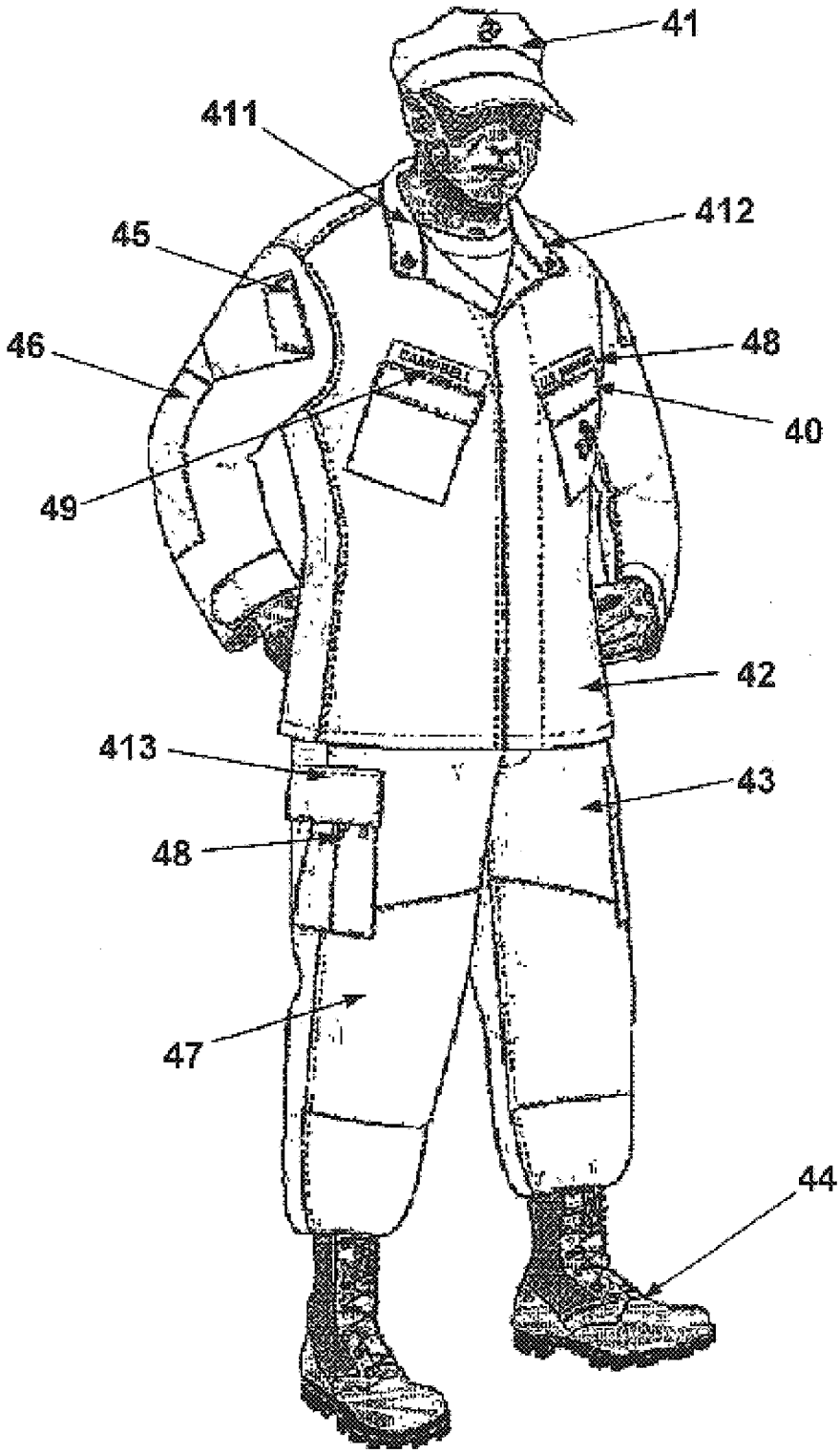
FIG. 4 is an overall view of United States Marine Corps Combat Utility uniform with boots and Garrison cover. The trousers are bloused, and the boots are coyote brown leather with the rough side out.
Figure 5:
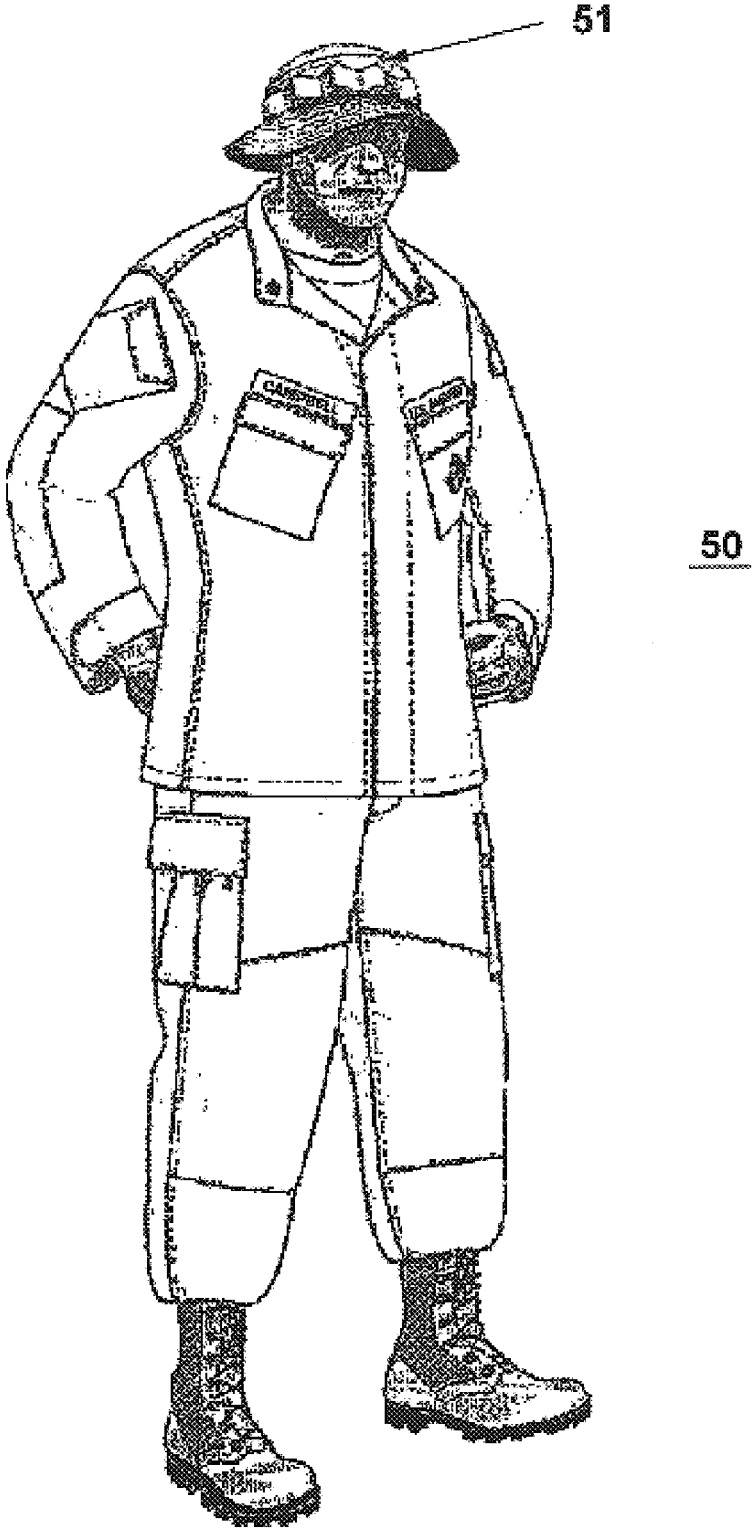
FIG. 5 is an overall view of United States Marine Corps Combat Utility uniform with trousers bloused and "Boonie" Hat.

New garment designs were developed to provide the Marines with a more functional (combat utility) durable and easy care uniform. Referring to FIGS. 4 & 5, the uniform 40 is a 2-piece blouse 42 and trouser 43 design to optimize fit and maximize freedom of movement and ventilation. The blouse and trousers are each available in 26 sizes to fit 90 percent of the USMC population.

The blouse has a COLLAR 411 designed to enable Marines to close out the elements (i.e. sand and wind) in the stand-up position yet lie flat under body armor in the fold-down position without bunching. The area of the collar also provides sufficient area for placement of rank insignia 412.

CHEST POCKETS 49 are angled at approximately 65 degrees to improve ergonomics making it easier for hand entry and content retrieval. Hook and Loop closures are provided for all pockets to eliminate any closure impression and abrasion point associated with armor and load bearing wear. Velcro (hook & loop) type closures are not suitable for military use because they make too much noise but are acceptable in civilian or hunter sportsman type environments.

Figure 6:
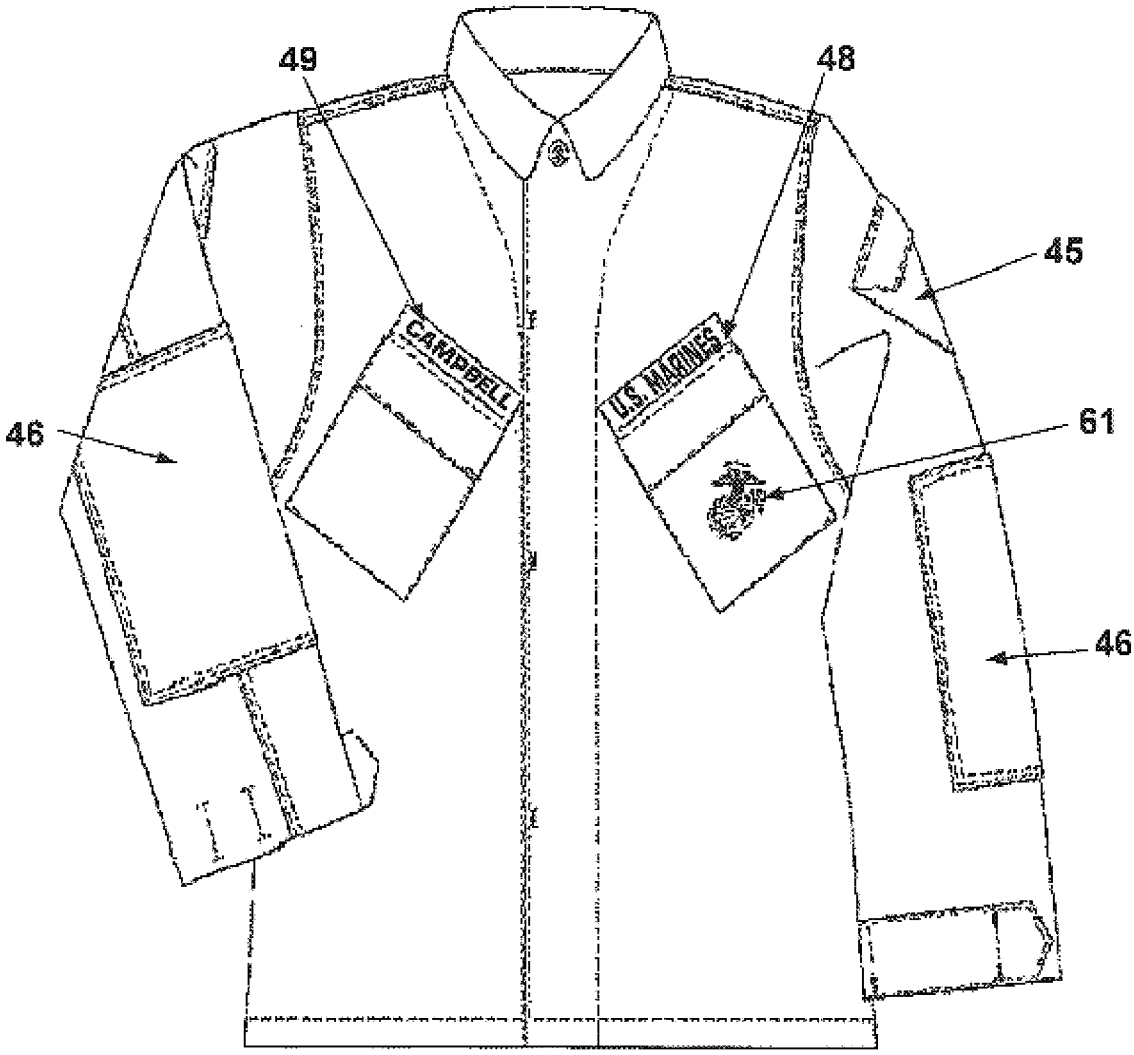
FIG. 6 is a front view of the United States Marine Corps Combat Utility uniform blouse.
Figure 7:
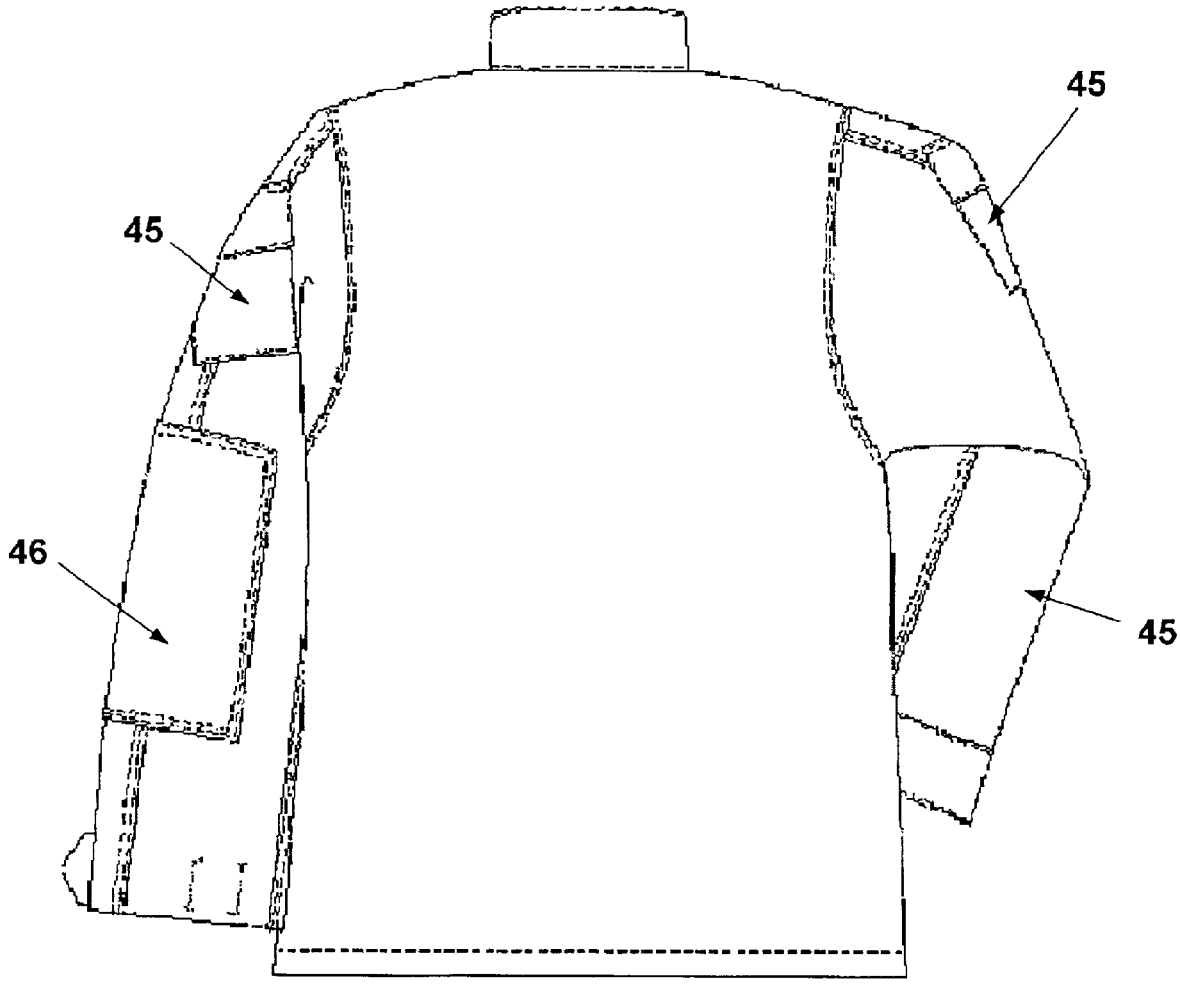
FIG. 7 is a back view of the United States Marine Corps Combat Utility uniform blouse.

EAGLE, GLOBE AND ANCHOR EMBLEM 61 of FIG. 6 is permanently embroidered for visibility and Service recognition. This is a feature of interest to USMC but not critical to the camouflage value of the fabric. The blouse 42 has a TAPERED WAIST to provide an automatic fit and eliminate the need for additional hardware to adjust waist for tapered fit and avoid abrasion points while wearing combat equipment. The sweep of the blouse is smooth that minimizes bulk to tuck into trousers, which is needed in certain military and sport operations such as rappelling.

SLEEVE POCKETS 45 are positioned on the upper sleeve so they are readily accessible when body armor and load bearing equipment is worn. Pocket size and angle of set is provided to house and readily retrieve small items needed for combat such as: compass, maps, field books, and personal items. The flap of the pocket 45 has a five-point configuration that provides a good appearance yet secures contents.

On all pocket flaps, except the chest pockets, TAB POCKET FLAPS with a hidden 2-button closure 413 are used. This configuration prevents buttons from snagging and provides user flexibility to have partial entry with one button closure. Buttons also provide silent operation in a tactical environment, and are easily repaired by the user to extend service life of the garments.

ELBOW PATCH/PADDING 46 provides a reinforced external patch on the elbow at the point of highest abrasion. The patch 46 also serves to enable design of a pocket for insertion of elbow padding for the inside of the sleeve. The padding opening is achieved with an overlapping welt opening with a low profile, which is orientated to prevent the hand from snagging when donning the blouse, and positioned so that it is not visible when sleeves are rolled for garrison wear.

SLEEVE CUFF 50 of FIG. 6 is a button on a tab that can be passed through one of three closing buttonhole openings on the cuff. This arrangement accomplishes adjustment of the sleeve cuff opening. This mechanism allows adjustability of the sleeve cuff while keeping the button from being exposed on the outside creating a snag hazard.

TROUSER WAIST ADJUSTMENT 81: Each size of trousers fits four sizes of Marines based upon waist circumference. An automatic elastic waist adjustment 81 is incorporated to eliminate the need for waist adjustment hardware which has proven unreliable in the field and can provide an abrasion point on the body because of wear from load bearing equipment over the hardware. Encased elastic is provided at the two sides to provide an automatic stretch or relaxation to fit comfortably over four inches of variation in waist circumference. Of course, such an arrangement is very useful in a sport arrangement.

Figure 8:
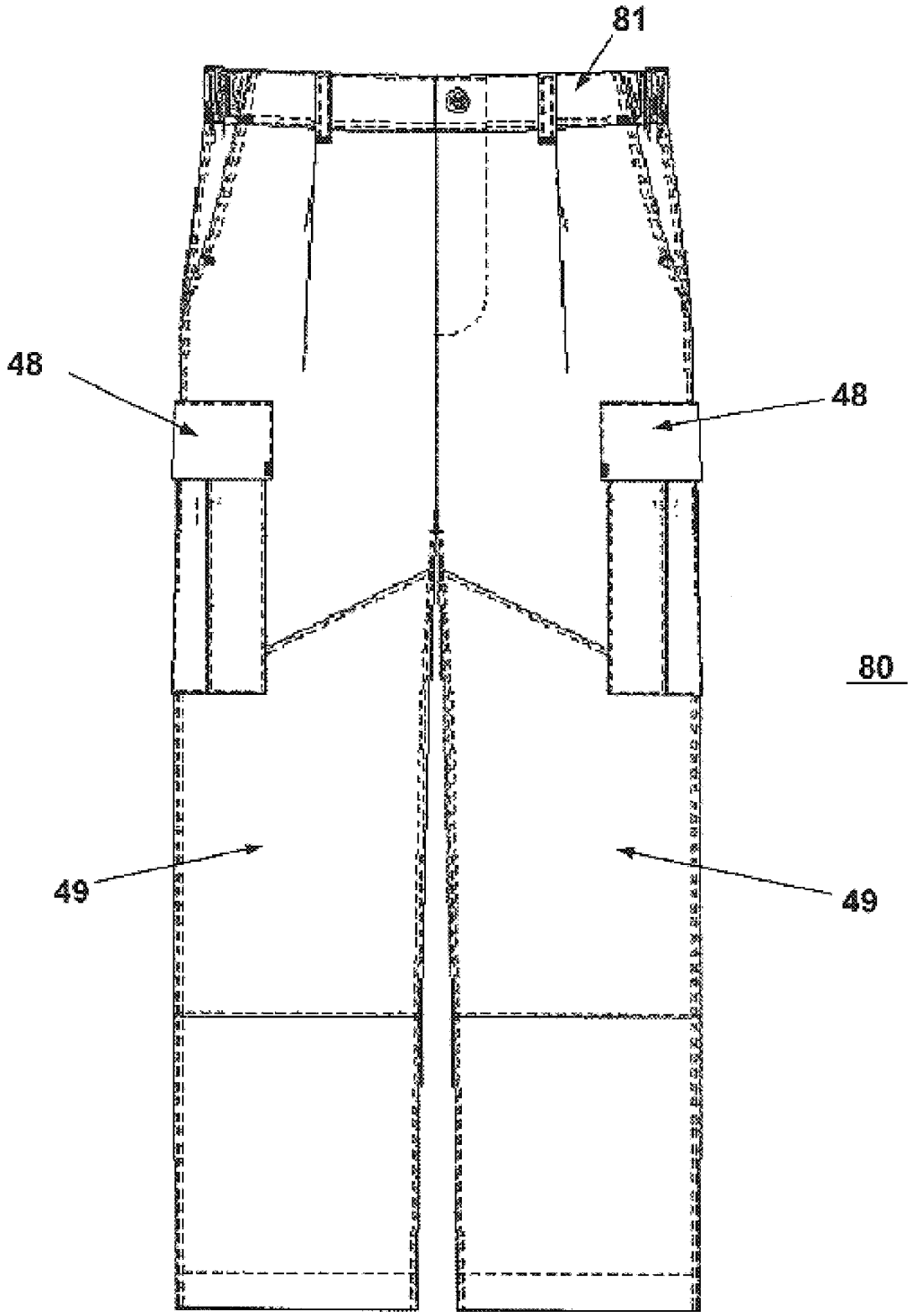
FIG. 8 is a front view of the United States Marine Corps Combat Utility uniform trousers unbloused.
Figure 9:
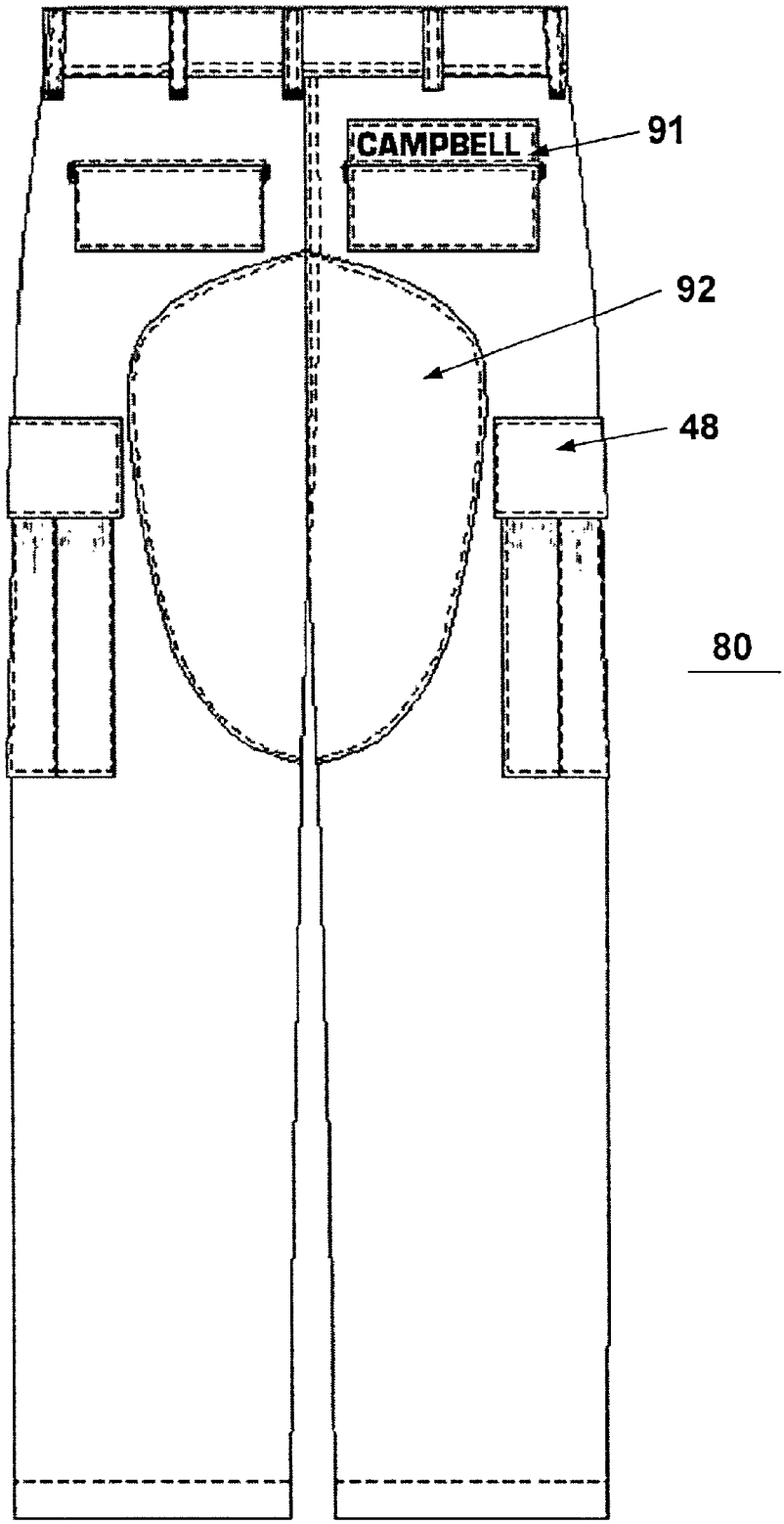
FIG. 9 is a back view of the United States Marine Corps Combat Utility Uniform trousers unbloused.

PLEATS 47 of FIG. 8: One pleat on each side of the front of the trouser is provided to create added ease of movement and comfort to the wearer. CARGO POCKET 48: the cargo pocket consists of backside and bottom bellows and two front pleats to enable the pocket volume to expand. The top edge is elasticized to keep contents secure. The elasticized edges keeps the opening sizes restricted and close to the body and yet will stretch so that the hand can easily enter pocket without any adjustment. A secondary pocket closure of button flap is provided to maximize content security.

SEAT PATCH 92 is a circular seat patch is provided as additional reinforcement at high abrasive wear area in a shape which is configured to minimize stress on the stitches and to prevent opening seams.

KNEE PATCH AND PADDING 49, an external knee patches is provided for added reinforcement for a high abrasive wear point. The angular upper edge of the patch is provided to minimize strain on the trouser fabric and to disperse the stress over a larger area and to minimize tearing directly above knee patch stitching. The knee patch also serves to create a pocket for insertion of knee padding from the inside of the trouser leg. The padding opening is achieved with an overlapping welt opening with a low profile, which is orientated to prevent the foot from snagging when donning the trouser.

PERMANENT PRESS: the uniform blouse and trouser are permanent press treated to provide a wrinkle free fabric appearance with continuous home washing and tumble dry. Home care eliminates heavy starching for wrinkle free appearance that improves fabric permeability and therefore comfort as well as eliminate sheen that enhances detection from light reflection when under surveillance. Permanent sleeve and trouser creases are provided to provide a good appearance without the need and detriments of starch pressing. To obtain the ultimate level of permanent press/wrinkle free performance needed for a frequently used and laundered item, USMC found that applying the resin finish to the garment provided far better results than applying a post-cured resin finish to the open width fabric. The following processing method was used: the garments were placed in a modified production type laundering equipment and treated to the point of saturation, with a formulation containing dimethyloldihydroxyethyleneurea (DMDHEU) resin, magnesium chloride catalyst polyethylene softeners and binders specifically appropriate for nylon/cotton blend fabrics. The garment is then extracted to a controlled wet pick up and dried to about 9 percent moisture. The dried garment is appropriately pressed to impart the required crease in the blouse and the trouser. The final step in the permanent press finishing process, is the curing of the resin treatment, to insure cross-linking of the resin with the cellulose component in the fiber blend. The garments are cured at 325–350° F. for 10–12 minutes. This permanent press finishing process imparts a high level of permanent press performance with minimum adverse affect on the strength properties of the fabric. The fabric received smoothness rating of 5.0 initially and 4.5 after 20 launderings. The pressed-in crease on the sleeve rated 4.5 initially and 3.0 after 20 launderings and the pressed-in crease on the trouser rated a 5.0 initially and 4.5 after 20 launderings. Testing was performed in accordance with AATCC Test Method 14.

Having described the invention, the following examples are given to illustrate specific applications of the invention.

Example 1

Greenwood Mills spun yarn made from a blend of 50+/−5% polyamide (nylon type 6,6) manufactured by Dupont as type 420, with a denier per filament of 1.6–1.8, and the remaining percentage combed American Uplands cotton. The yarn for the fabric warp was 20 cotton count, two-ply, and the yarn for the fabric filling was 16 cotton count, singles. Greenwood Mills wove the fabric in a 2/1 left-hand twill. The fabric was desized, scoured, dyed and printed by Bradford Dyeing Association. The greige material was dyed the ground shade of Khaki 475 using the appropriate amounts/combinations of Acid Blue 258 and Tectilon Orange GV4R and than overprinted with vat dyes (Vat yellow 2, Vat green 1, Vat brown 57 and Vat Orange 6, and Sulfur black 6) using rotary screen printing process for each of the 3 remaining colors (green 474, coyote 476, and black 477) for the woodland camouflage pattern. The camouflage printed and finished cloth had the following properties: Weight—6.5 oz/yd$^2$; Breaking Strength, warp by filling—188 by 134 pounds; Tearing Strength, warp by filling—8.4 by 6.9 pounds; Fabric Count, warp by filling—100 by 63 yarns per inch; Air Permeability—13 feet$^3$/minute/foot$^2$; Thickness—0.016 inches. The garments were permanent press treated by Warmkraft Inc. using modified-type-laundering equipment. The garments were treated with a formulation containing dimethyloldihydroxyethyleneurea (DMDHEU) resin, a magnesium chloride catalyst, polyethylene sulfurs and binders specifically appropriate for nylon/cotton blend fabrics. The treated garments were extracted, dried, pressed and cured to insure cross-links of the resins.

Example 2

Same as above except that the instead of using plain polyamide, a fine denier carbon core polyamide sheathed fiber or other electrostatic dissipating fibers are added to the fiber blend resulting in a total of 1 to 5% electrostatic dissipating fibers.

Example 3

The Woodland USMC color combination is printed by the above method to achieve a micro pattern of about 14 to about 18 percent black with a lightness value from about 14 to about 19; from about 42 to 50 percent coyote with the lightness value from about 28 to about 40; from about 28 to about 32 percent green with a lightness value from about 24 to about 33; and from about 3 to about 8 percent khaki with a lightness value from about 38 to about 50. The micro-pattern has a horizontal orientation although a vertical orientation will work as well.

Example 4

The fabric is printed as described above. The four color system is applied as follows in the percentage of specified color: (a) For the Woodland terrain, the colors and the percentage of each color are Black 477 (18%), Green 474 (30%), Coyote 476 (47%), and Khaki 475 (5%); (b) For Desert terrain, the colors and percentages are Light Coyote 481 (18%), Highland 480 (5%), Urban Tan 478 (30%) and Desert Light Tan 479 (47%); and (c) For the Urban terrain, the colors are Black 477 (5%), Medium Gray 487 (30%), Light Gray 486 (47%) and Coyote 476 (18%).

REFERENCES

Blakemore, C., and Campbell, F. On the existence in the human visual system of neurons selectively sensitive to orientation and size of retinal images. *Journal of Physiology,* 197, 1969, 551–556.

Blum, H. A new model of global brain function. *Perspectives in Psychology and Medicine,* 10(3), 1967, 381–408.

Blum, H. Biological shape and visual science (I). *Journal of Theoretical Biology,* 38, 1973, 205–284.

Blum, H. A geometry for biology. *Annals of the New York Academy of Sciences,* 231, 1974, 19–30.

Blum, H. 3-D axis coordinates: an overview and prospectus. Presentation at the National Science Foundation workshop at the University of Pennsylvania, 1–2 May 1979.

Blum, H. and Nagel, R. Shape description using weighted symmetric axis features. *Pattern Recognition,* 10, 1978, 167–180.

Brunswick Corporation. *Guide to Camouflage Detection for DARCOM Developers*. Fort Belvoir, Va.: US Army Mobility Equipment Research and Development Command in (1978).

Combat Developments Experimentation Command. Final Report, Dual-Textured Gradient Camouflage Paint Pattern. USACDEC Experiment 8 CEP 57 (1978).

Gibson, J. *The Ecological Approach to Visual Perception*. Boston: Houghton Mifflin, 1979.

Ginsburg, A. Psychological correlates of a model of the human visual system.

*Proceedings:* 1971 *National Aerospace Electronics Conference* (*NAECON*), Dayton, Ohio, 1971, 309–316.

Ginsburg, A. Visual information processing based on spatial filters contained by biological data. Dissertation for Ph.D., University of Cambridge, England, 1977. Also AMRLTR-78–179, Aerospace Medical Research Laboratory, Wright-Patterson AFB, OH, 1978.

Hannigan, J. Direct electronic Fourier transform (DEFT) spectra for surveillance and countersurveillance. Paper presented to the Army Science Conference, West Point, N.Y., 1978.

Harmon, L. and Julesz, B. Masking in visual recognition: Effects of two-dimensional filtered noise. *Science,* 180, 1973, 1194–1197.

Maffei, L. and Fiorentini, A. The visual cortex as a spatial frequency analyzer. *Vision Research,* 13, 1973, 1255–1267.

Marr, D. and Nishihara, H. Visual information processing: Artificial intelligence and the sensorium of sight. *Technology Review,* 81 (1), Massachusetts Institute of Technology, 1978.

O'Neill, T. Innovative Camouflage Design. Monograph prepared for U.S. Army Natick Laboratories. Alexandria, Va.: Star Mountain, Inc. (1995).

O'Neill, T. (1988) What the gunner's eye tells the gunner's brain, III: Prediction of visual target detection performance. Human Sciences Laboratory Technical Report 88-1, August 1988. Sponsor: ARI/MANPRINT (1988).

O'Neill, T. and Scott, B. What the gunner's eye tells the gunner's brain, II: Dazzle camouflage and gunner performance. Human Sciences Laboratory Technical Report 86-2. Sponsor TRADOC/TTD (1986b).

O'Neill, T. What the gunner's eye tells the gunner's brain, I: The nature of visual camouflage. Human Sciences Laboratory Technical Report 86-1 (1986a).

O'Neill, T. Dazzle camouflage. Paper presented to the Annual Meeting of the American Psychological Association, Toronto, Canada, August 1984.

O'Neill, T. Symmetry axis geometry and the perception of form. Paper presented at symposium at Long Island University, June 1983.

O'Neill, T. Symmetry axis geometry and the visual perception of form. Paper presented to the Annual Meeting of the Psychonomic Society, 1982.

O'Neill, T. Symmetry axis geometry and the perception of visual form. Unpublished dissertation presented to the faculty of the University of Virginia, August 1982.

O'Neill, T. (1978) Dual-texture camouflage. Paper presented to the Army Science Conference, West Point, N.Y.

O'Neill, T., Johnsmeyer, W., Brusitus, J., and Taylor, D. Evaluation of Dual Texture Gradient Camouflage. U.S. Military Academy, Office of Institutional Research, (1977a).

O'Neill, T., Johnsmeyer, W., Brusitus, J., and Taylor, D. Psychometric correlates of camouflage target detection. U.S. Military Academy, Office of Institutional Research, (1977b).

O'Neill, T., Johnsmeyer, W., Brusitus, J., and Taylor, D. Field evaluation of Dual Texture Gradient Camouflage. U.S. Military Academy, Office of Institutional Research (1977c).

Psotka, J. Perceptual processes that may create stick figures and balance. *Journal of Experimental Psychology: Human Perception and Performance,* 4, 1978, 101–111.

Pycraft, W. *Camouflage in Nature*. London: Hutchison & Company, 1925.

Thayer, G. *Concealing Color in the Animal Kingdom: an Exposition of the Laws of Disguise Through Color and Pattern*. New York: MacMillan, 1906.

Uttal, W. *An Autocorrelation Theory of Perception*. Hillsdale, N.J.: Erlbaum, 1975.

This technology can be applied to combat clothing uniforms and individual equipment such as load bearing, webbings, armor covers, shelters, hunting clothing items and accessories, etc. These specific examples are not intended to limit the scope of the invention described in this application. Obviously, many modifications and variations of the present invention are possible in light of the above teachings. It is therefore to be understood that, within the scope of the appended claims, the invention may be practiced otherwise than as specifically described.

What is claimed is:

1. A disruptive camouflage pattern system consisting of a macro pattern and a micro pattern wherein the micro pattern is formed of sharp edged pixels proportional to the size of a camouflaged subject, the pixels are in at least four colors with a gradation of colors from dark to light wherein the pattern repeats in set intervals and, within the repeat of the pattern, the lightest color is a base color including approximately 5% of the repeat, the next darkest color including approximately 47% of the repeat, the next darkest color including approximately 30% of the repeat, and the darkest color including approximately 18% of the repeat, combinations of the micro pattern pixels form shapes of the macro pattern, combinations of the micro pattern pixels forming a specific macro pattern shape can be of the same or different colors, the macro pattern shape disrupts the shape of the camouflaged subject, the ratio of light to dark pixels in the micro pattern blends the subject into the background, the combined effect of the micro and macro pattern provides disruptive camouflage in both the human visible and near infrared light range and the camouflaged subject has a Lightness value (L*), that is comparable to the negative space surrounding the camouflaged subject.

2. The disruptive pattern system of claim 1 wherein the color palette is selected from color groups referred to as Woodland, Desert and Urban.

3. The disruptive pattern system of claim 2 wherein the Woodland color group is a combination of black, green, coyote and khaki listed in order from darkest to lightest color.

4. The disruptive pattern system of claim 2 wherein the Desert color group is a combination of highland, light coyote, urban tan and desert light tan listed in order from darkest to lightest color.

5. The disruptive pattern system of claim 2 wherein the Urban color group is a combination of black, medium gray, coyote and light gray listed in order from darkest to lightest color.

6. The disruptive pattern system of claim 2 where the pattern is printed on a fabric consisting of from about 30% to about 80% nylon and the remainder is cotton.

7. The disruptive pattern system of claim 6 where the fabric consists of 50% nylon and 50% cotton.

8. The disruptive pattern system of claim 2 wherein the lightness value (L*) of the system decreases between 17% and 28% in the wet state from that of the dry state.

9. The disruptive pattern system of claim 6 wherein the lightness value (L*) of the system decreases between 17% and 28% in the wet state from that of the dry state.

10. The disruptive pattern system of claim 7 wherein the lightness value (L*) of the system decreases between 17% and 28% in the wet state from that of the dry state.

* * * * *